US007121588B1

(12) United States Patent
Benn

(10) Patent No.: US 7,121,588 B1
(45) Date of Patent: Oct. 17, 2006

(54) FOLDER WITH A CLAMPING DEVICE

(75) Inventor: Alexander Benn, Stuttgart (DE)

(73) Assignee: Biella-Neher AG, Bruegg b. Biel (CH)

( * ) Notice: Subject to any disclaimer, the term of this patent is extended or adjusted under 35 U.S.C. 154(b) by 0 days.

(21) Appl. No.: 11/320,726

(22) Filed: Dec. 30, 2005

(30) Foreign Application Priority Data

Jun. 28, 2005 (EP) ..... 05105765

(51) Int. Cl.
*B42D 3/00* (2006.01)

(52) U.S. Cl. ..... 281/29; 281/45; 281/21.1; 402/73; 29/67.1

(58) Field of Classification Search ..... 281/15.1, 281/29, 35–37, 45, 21.1; 402/57, 73; D19/26–27; 229/67.1, 67.2, 67.3, 67.4
See application file for complete search history.

(56) References Cited

U.S. PATENT DOCUMENTS 1,507,433 A * 9/1924 Schaffert ..... 40/359
2,275,927 A 3/1942 Thomas
4,551,039 A * 11/1985 Basseches ..... 402/60
5,212,850 A * 5/1993 Rerolle ..... 24/67 AR
5,472,238 A 12/1995 Sato
5,957,501 A 9/1999 Van Ardenne
2006/0055167 A1* 3/2006 Pollman et al. ..... 281/21.1

FOREIGN PATENT DOCUMENTS

EP 1 074 401 A1 2/2001

* cited by examiner

*Primary Examiner*—Monica Carter
*Assistant Examiner*—J Williams
(74) *Attorney, Agent, or Firm*—Oblon, Spivak, McClelland, Maier & Neustadt, P.C.

(57) ABSTRACT

A folder with a clamping device for receiving material in sheet form includes a jacket made of a flat, flexible material. By means of a first indentation configuration, this is divided up into a rear leaf and a backbone part and by means of a second indentation configuration into the backbone part and front leaf. The clamping device is provided in a corner region of the rear leaf, adjacent to the backbone part, so that the material in sheet form, insertable into the folder, is held clamped in the respective corner region by the clamping device. The corner region of the rear leaf wherein the clamping device is provided is delimited with respect to the rear leaf by a first crease and the corner region of the front leaf is delimited with respect to the front leaf by a second crease.

12 Claims, 8 Drawing Sheets

FOLDER WITH A CLAMPING DEVICE

BACKGROUND OF THE INVENTION

The present invention relates to a folder with a clamping device for receiving material in sheet form, comprising a jacket made of a flat, flexible material, which is divided up by means of a first indentation configuration into a rear leaf and a backbone part, and by means of a second indentation configuration into the backbone part and a front leaf, and the clamping device is provided in a corner region, adjacent to the backbone part, of the rear leaf, so that the material in sheet form insertable in the folder is able to be held clamped in the respective corner region by the clamping device.

Folders of this kind are known. For example, EP-A 1 074 401 shows such a folder in which the paper to be placed in this folder is held clamped in the upper corner region adjacent to the backbone part of the folder. The clamping device can be pivoted up, the material in sheet form can then be placed on the rear leaf, the clamping device is pivoted back, and the material in sheet form is thus held clamped in the folder in the upper corner region.

Now, if one is supposed to leaf through the material in sheet form held clamped in the corner region in this folder, one opens the front leaf, and the individual sheets of the material in sheet form held clamped can then be turned up over the clamping device. As long as the turning of the pages of the material in sheet form, held clamped in this folder, takes place when this folder is lying on a flat support, no problems arise, since the material being leafed through can also rest on this flat support.

If, however, no flat support, on which this folder can be set down, is available for leafing through this material in sheet form, held clamped in the folder, but instead the folder has to be held freely in one's hand, the front leaf is usually bent over until it practically rests on the rear leaf, whereupon the sheets, held clamped, are flipped around the clamping device over the corner. These turned pages are then preferably also flipped over so far that they touch the likewise flipped-over front leaf, and can thus be held.

With this type of use of this folder it has been shown that it is not entirely easy to hold the turned-over sheets with the bent-over front leaf, since the sheets have to be turned over the clamping device, which holds in a clamped way the respective corner region of the material in sheet form, and forms the corner region of the folder. A big bulge thereby occurs in the turnover region of the material in sheet form, and the turned-over sheets end up only partially on the flipped-over front leaf of this folder, whereby the holding of this folder with the turned-over sheets becomes hardly possible anymore using one hand.

SUMMARY OF THE INVENTION

The object of the present invention therefore is to create a folder with a clamping device by means of which the material in sheet form is clamped in the corner region, and wherein space is created in the corner region with the clamping device by means of the turning over of the front leaf, so that the material in sheet form to be leafed through over this corner region can be turned over in an optimal way.

This object is achieved according to the invention in that the corner region of the rear leaf, in which the clamping device is provided, is delimited with respect to the rear leaf by at least a first crease, which first crease runs from the first indentation configuration to the top edge of the rear leaf, and wherein the corner region of the front leaf, corresponding to the corner region of the rear leaf, is delimited with respect to the front leaf by at least one second crease, which second crease runs from the second indentation configuration to the top edge of the front leaf.

Achieved with this design is that, upon opening the front leaf by more than 180°, the two corner regions of the front leaf and of the rear leaf, the latter being that on which the clamping device is disposed, are pivoted away, toward the rear, about the first crease or respectively about the second crease, and, with the front leaf opened all the way, the two corner regions with the clamping device come to lie between this front leaf and the rear leaf, the corner area being thereby completely cleared, and the turning of the material in sheet form, held clamped in this folder, thus being able to take place in an optimal way.

A preferred embodiment of the invention consists in the first crease and the second crease being disposed symmetrically with respect to the backbone part, and each running from the backbone part at an angle of inclination of about 45°. An optimal bending down of the folded area of the folder is thereby obtained, and the completely turned-over material in sheet form then lies substantially congruently on the completely opened front leaf.

Preferably, a cut is provided in the backbone part between the first crease and the second crease, whereby the pivoting away of the corner regions is facilitated.

Preferably, the first crease and the second crease are each formed by at least two folding lines running parallel to one another, whereby an optimal tilting down of the corner regions is achievable.

The first indentation configuration and the second configuration are also each formed by at least two folding lines running parallel to one another; the opening of the front leaf practically onto the rear leaf is thereby optimized here too.

A further preferred embodiment of the invention consists in the folding lines being provided as impressions stamped in the material forming the jacket. Besides the simple turning of the respective parts, achieved in addition is that the two corner regions tend to pivot out in the correct direction when the front leaf is opened and bent back.

Preferably, adjacent to the cut provided in the backbone part is a further cut, which runs along the first crease in the rear leaf, and extends to a middle region of the overall length of the first crease, whereby a bending of the corner regions in the correct direction is ensured when the folder is opened.

A further improvement in the pivoting out of these corner regions in the correct direction when opening the folder is achieved in that an additional cut is provided in the front leaf along a middle region of the overall length of the second crease.

To facilitate the insertion of the material in sheet form into the folder and the fixing of the clamping device, a tab is disposed on the rear leaf in the corner region at the edge, which tab is able to be turned down about a further crease in the corner region, aligned parallel to the edge, of the rear leaf.

Preferably, the clamping device is formed by two clamping surfaces lying one above the other, which are connected to each other via a crosspiece, and take the shape of a triangle corresponding substantially to the corner region formed by the first crease. Achieved besides an optimal clamping of the material in sheet form in the folder is, in addition, that this clamping device is able to be pivoted away with the corner regions in an optimal way when the folder is opened.

Preferably, the clamping device is provided with a bolt aligned perpendicular to the clamping surfaces, which bolt penetrates the rear leaf in the corner region, and about which bolt the clamping device is pivotable. By means of the back and forth pivoting of this clamping device, the material in sheet form can be held clamped in the folder, or respectively released again, in an easy way.

The clamping device is preferably made of a flexible material, it being thereby possible to achieve a simple manufacture of this clamping device, in addition to optimal clamping.

BRIEF DESCRIPTION OF THE DRAWINGS

An embodiment of the invention will be explained more closely in the following, by way of example, with reference to the attached drawing.

DETAILED DESCRIPTION OF THE PREFERRED EMBODIMENT

Figure 1:
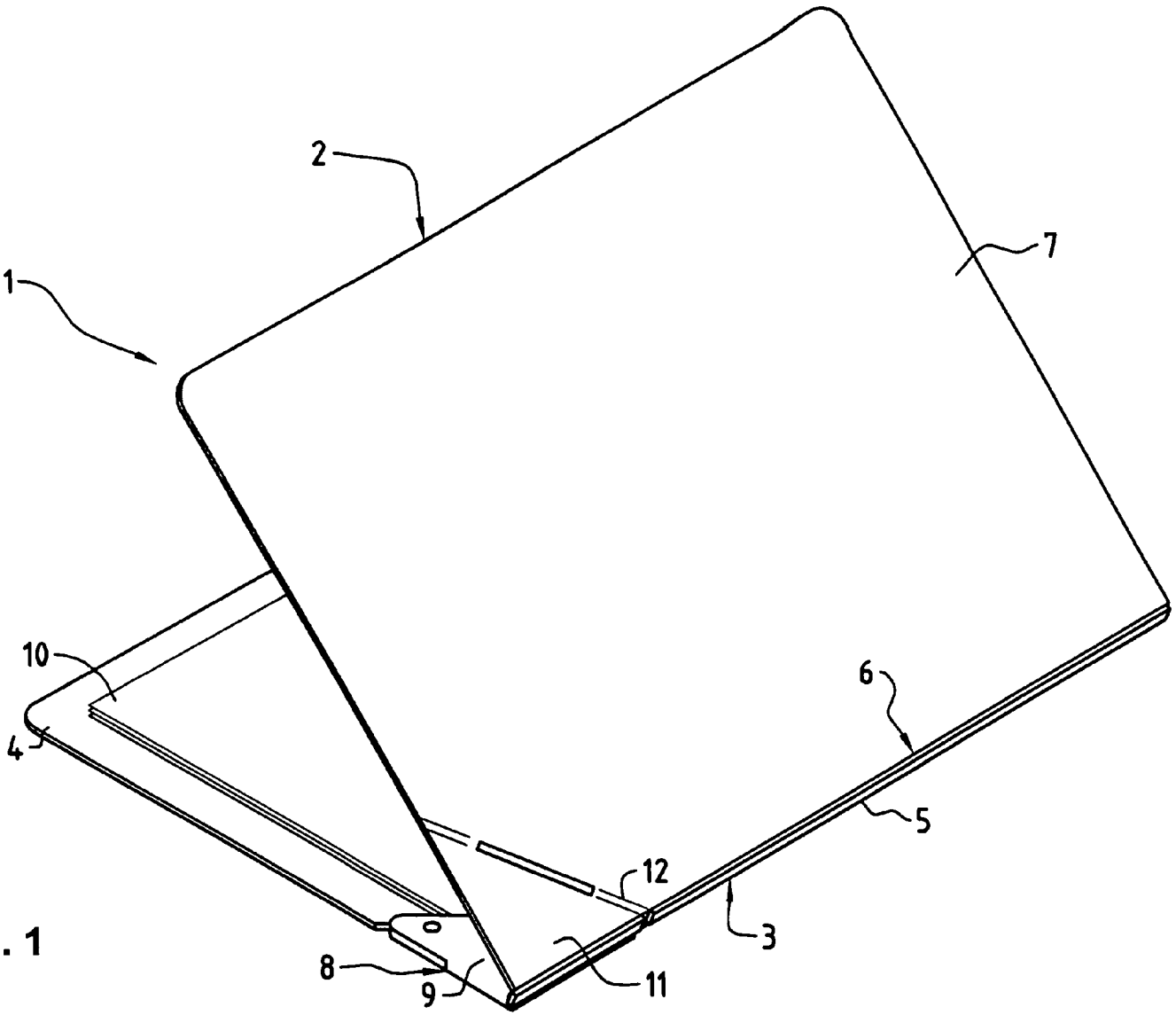
FIG. 1 is a spatial representation of a folder according to the invention with inserted material in sheet form and slightly lifted up front leaf.

As can be seen from FIG. 1, the folder 1, which is made of a flat, flexible material, consists of a jacket 2, which is divided up into a rear leaf 4 and a backbone part 5 by a first indentation configuration 3. A second indentation configuration 6, adjacent to the backbone part 5, separates this backbone part from a front leaf 7. As will be described later, the first indentation configuration 3 and the second indentation configuration 6 are formed by folding lines which are provided as impressions stamped in the jacket 2.

Provided in a corner region 8 of the rear leaf 4 is a clamping device 9, which will be described later in detail. By means of this clamping device 9, material in sheet form 10 is insertable in the folder 1, and can be held clamped by the clamping device 9 at the respective corners which come to lie on the corner region 8 of the rear leaf 4.

As will be seen later, the corner region 8 of the rear leaf 4, on which the clamping device 9 is disposed, is delimited with respect to the rear leaf 4 by a first crease 16. The corresponding corner region 11 of the front leaf 7 is delimited with respect to the front leaf 7 by a second crease 12.

Figure 2:
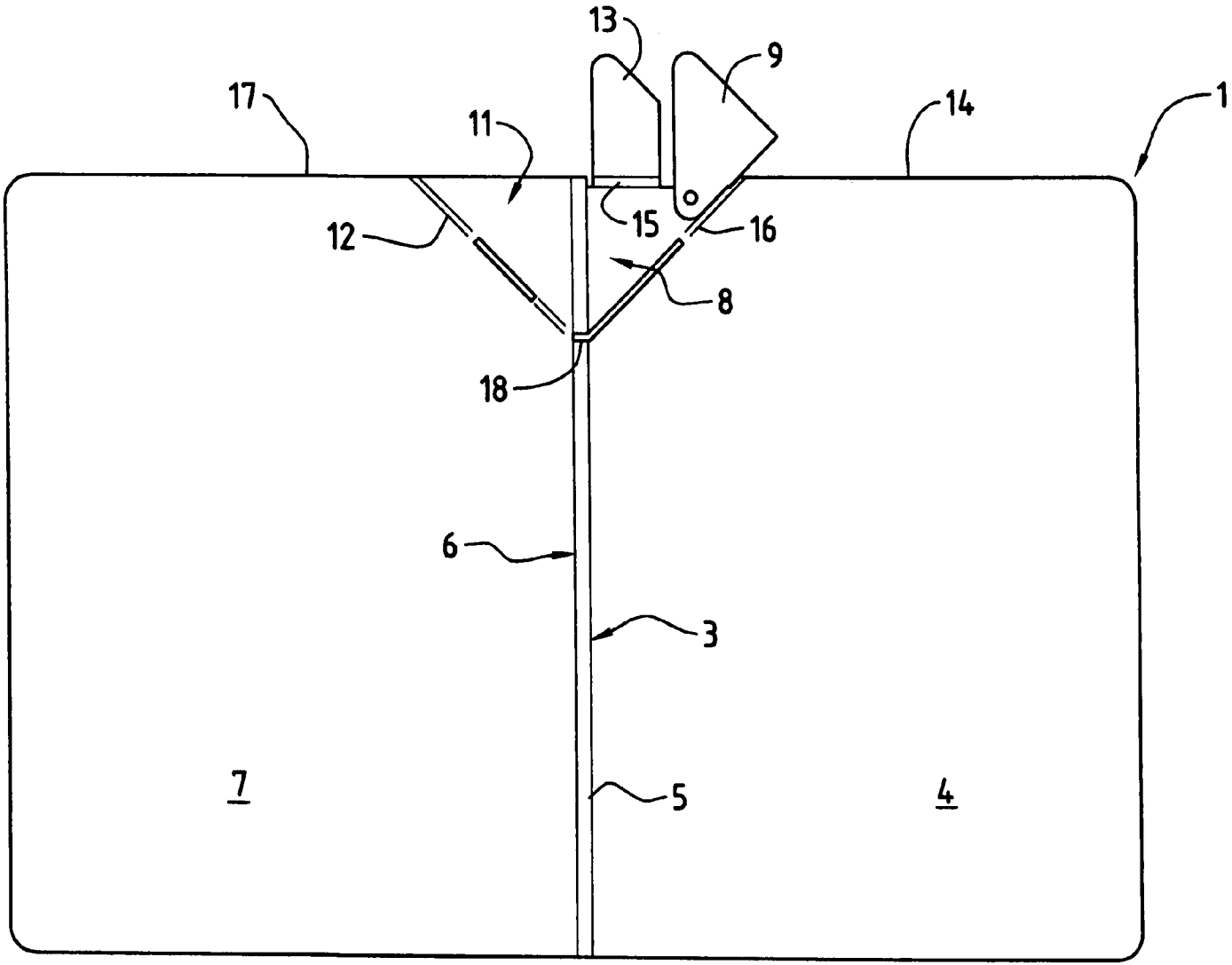
FIG. 2 is a view from above of the folder according to the invention with opened front leaf and pivoted out clamping device.

The folder 1 can be seen in FIG. 2, the front leaf 7 being in completely opened state and lying in a plane with the rear leaf 4. Visible in this illustration are the first indentation configuration 3 and the second indentation configuration 6, which divide up the jacket 2 into the rear leaf 4, the backbone part 5, and the front leaf 7. As can already be seen from FIG. 1, the rear leaf 4, the backbone part 5 and the front leaf 7, respectively, are able to be turned about the first indentation configuration 3 and the second indentation configuration 6.

Disposed in the corner region 8 of the rear leaf 4 is the clamping device 9, which is situated in the pivoted-up position in this illustration. Also disposed on the rear leaf 4, in the corner region 8 of the rear leaf 4, is a tab 13, which is able to be turned down over a further crease 15 in the corner region 8 of the rear leaf 4, aligned parallel to the edge 14 of the rear leaf 4.

The corner region 8 of the rear leaf 4 is delimited with respect to the rear leaf 4 by a first crease 16. This first crease 16 runs from the first indentation configuration 3 diagonally toward the upper edge 14 of the rear leaf 4. The second crease 12 is provided in a corresponding way on the front leaf 7, which crease runs from the second indentation configuration 6 diagonally toward the upper edge 17 of the front leaf 7. The corner region 11 of the front leaf 7 is formed by this second crease 12. The first crease 16 and the second crease 12 are symmetrically disposed with respect to the backbone part 5, and enclose an angle of 90° in this embodiment example, or respectively each enclose an angle of 45° in relation to the backbone part 5.

The connection in the backbone part 5 between the first crease 16 of the rear leaf 4 and the second crease 12 of the front leaf 7 is obtained by means of a cut 18 provided in the backbone part 5.

Figure 3:
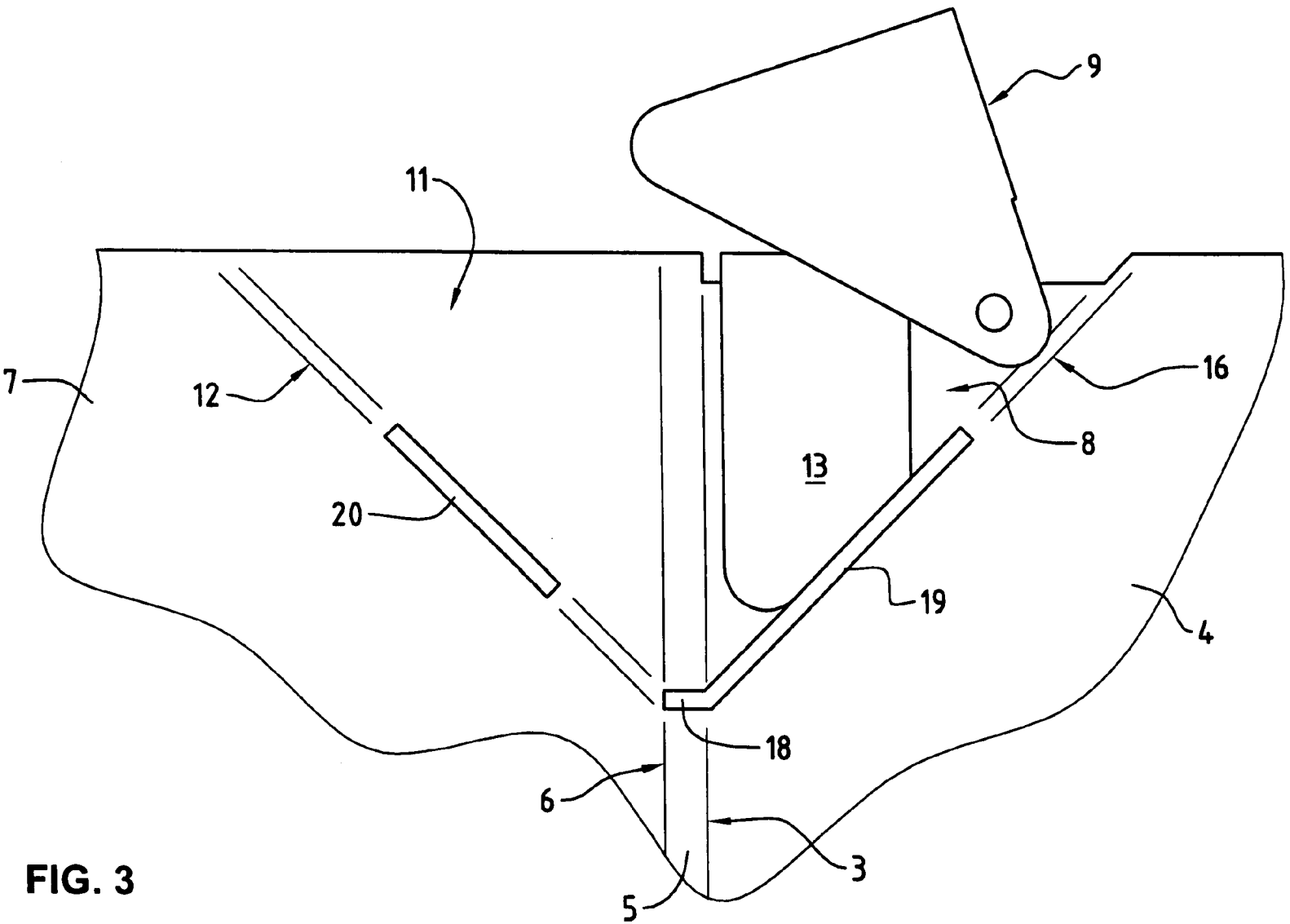
FIG. 3 is an enlarged view from above of the clamping device and the two corner regions of the front and rear leaf.

Seen in FIG. 3, in an enlarged view, are the corner region 8 of the rear leaf 4 and the corner region 11 of the front leaf 7. These two corner regions 8 und 11 are each delimited from the respective leaf 4, or respectively 7, by the first crease 16, or respectively the second crease 12.

Likewise visible in this FIG. 3 is the cut 18, which is provided in the backbone part 5 between the first crease 16 and the second crease 12. Adjacent to this cut 18 is a further cut 19, which runs along the first crease 16 in the rear leaf 4, and which extends to a middle region of the overall length of the first crease 16. Provided in the front leaf 7 is an additional cut 20, which runs along a middle region of the overall length of the second crease 12. How these cuts work will be described later on.

As can also be seen from FIG. 3, before pivoting the clamping device 9 into the corner region 8 of the rear leaf 4, the tab 13 is turned in, and material in sheet form to be inserted in the folder 1 thus comes to lie between this tab 13 and the rear leaf 4. By means of this tab 13, the clamping device 9 can be slipped onto the stack of sheets in a simple way, without sheets being pushed back or wrinkled.

Figure 4:
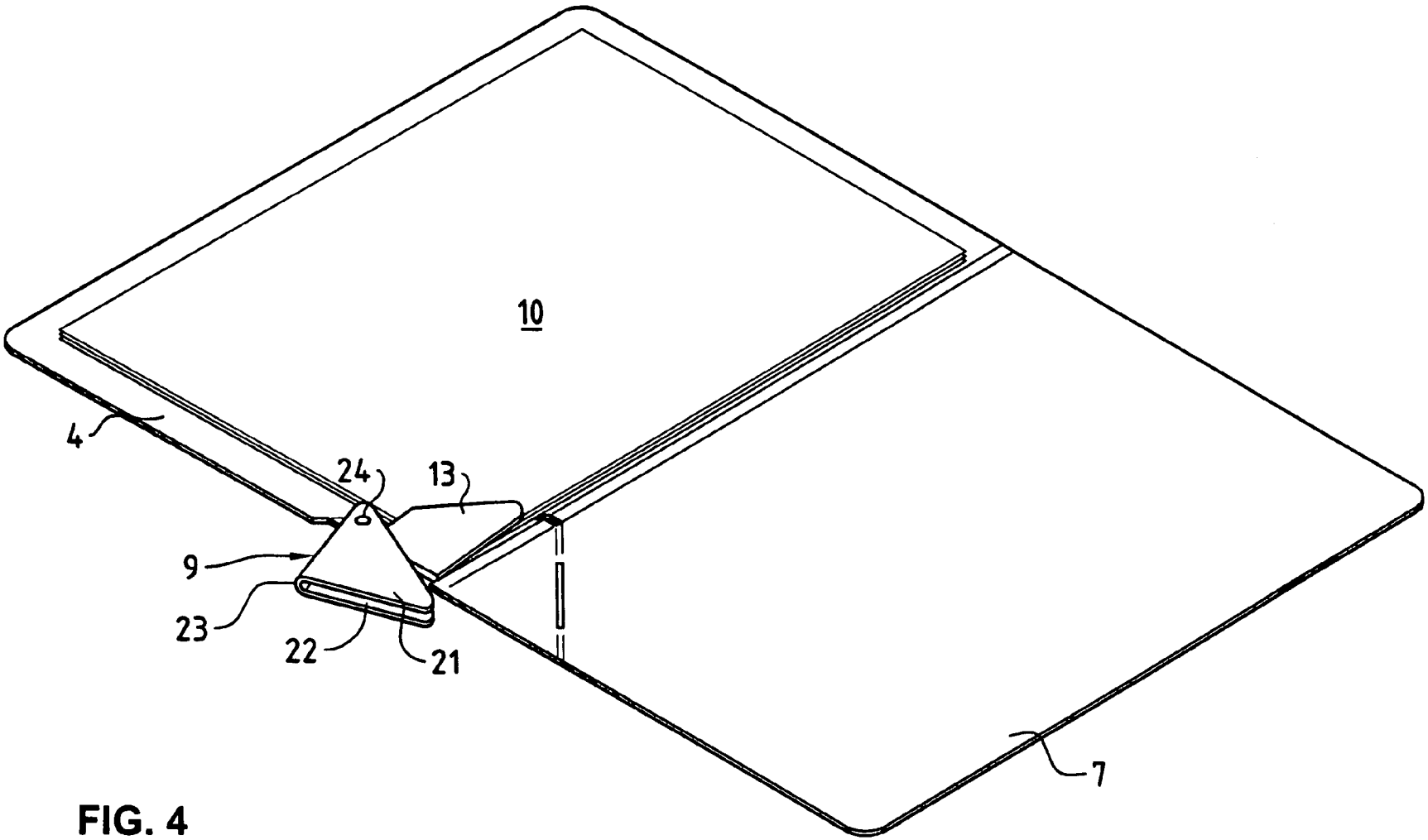
FIG. 4 is a spatial representation of the folder according to the invention with front leaf opened by 180° and clamping device pivoted out.

This state shown in FIG. 3 can also be seen in FIG. 4, material in sheet form 10 being inserted in the folder 1 here and the tab being placed over this material in sheet form 10; the clamping device 9 can now be swung shut.

As can be seen from this illustration, the clamping device 9 consists of two clamping surfaces 21 and 22, lying one over the other, which are connected to one another via a crosspiece 24. Through these clamping surfaces 21 and 22 the shape of a triangle is formed, corresponding substantially to the corner region 8 of the rear leaf 4 formed by means of the first crease 16. The clamping device 9 is provided with a bolt 24, aligned perpendicular to the clamping surfaces 21 and 22, which penetrates the rear leaf 4 in the corner region 8, and about which the clamping device 9 is pivotable. The clamping device 9 here is made of a flexible material, for example metal or plastic, whereby it is ensured that the material in sheet form, inserted in the folder 1 and held clamped by the clamping device 9, is held clamped in an appealing way.

Figure 5:
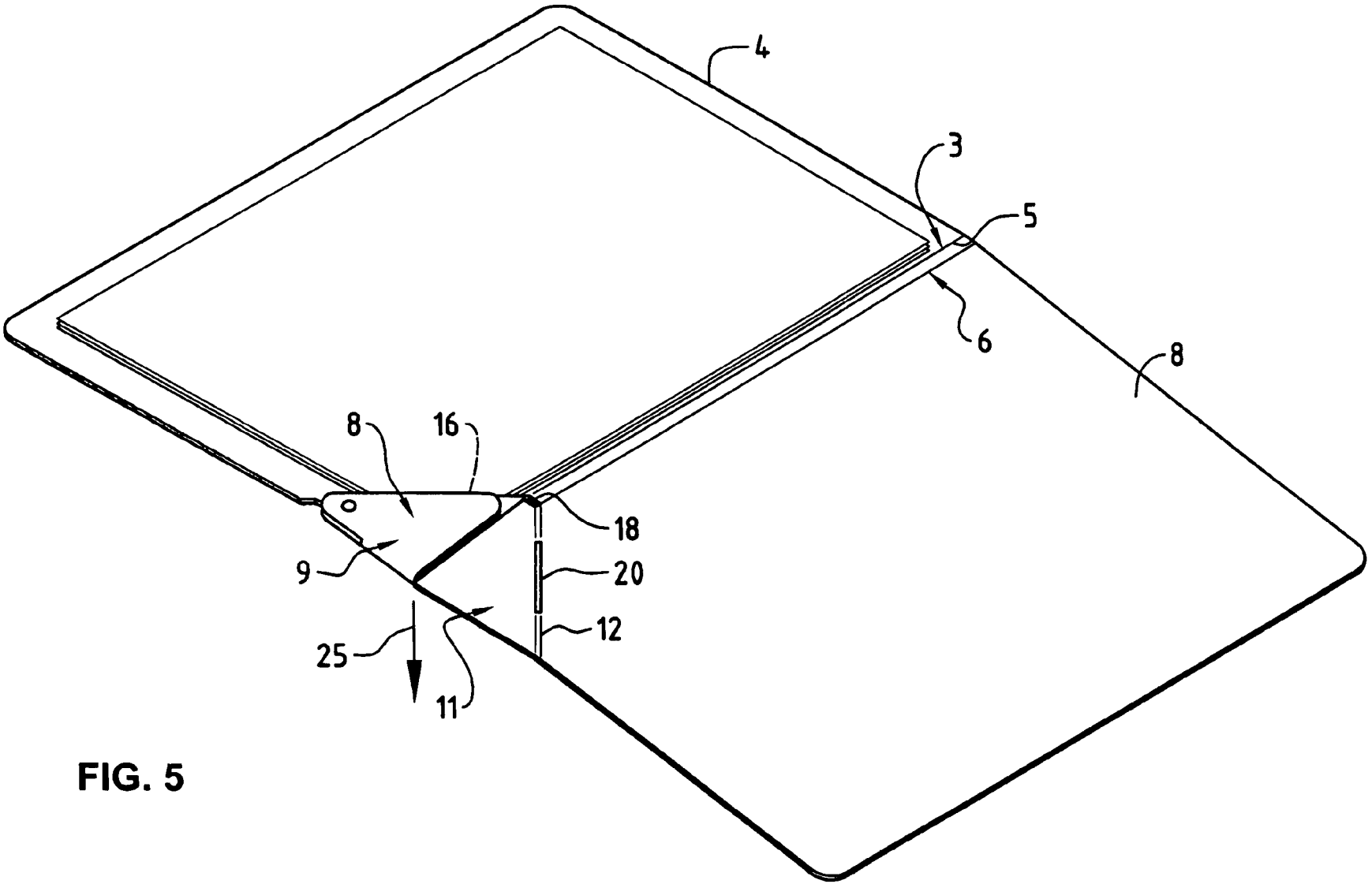
FIG. 5 is a spatial representation of the folder according to the invention in which the clamping device is situated in the clamping position, and in which the front leaf is opened by more than 180°, the clamping device with the two corner regions being pivoted away downward.

Now, when the front leaf 7 is turned further, with respect to the rear leaf 4, about the first indentation configuration 3 and the second indentation configuration 6, and surpasses the stretched-out position, as this is shown in FIG. 5, the first crease 16 and the second crease 12 together with the cut 18 cause the corner region 8 of the rear leaf 4 and the corner region 11 of the front leaf 7, together with the clamping device 9, to bend out toward the rear, shown by the arrow 25.

Figure 7:
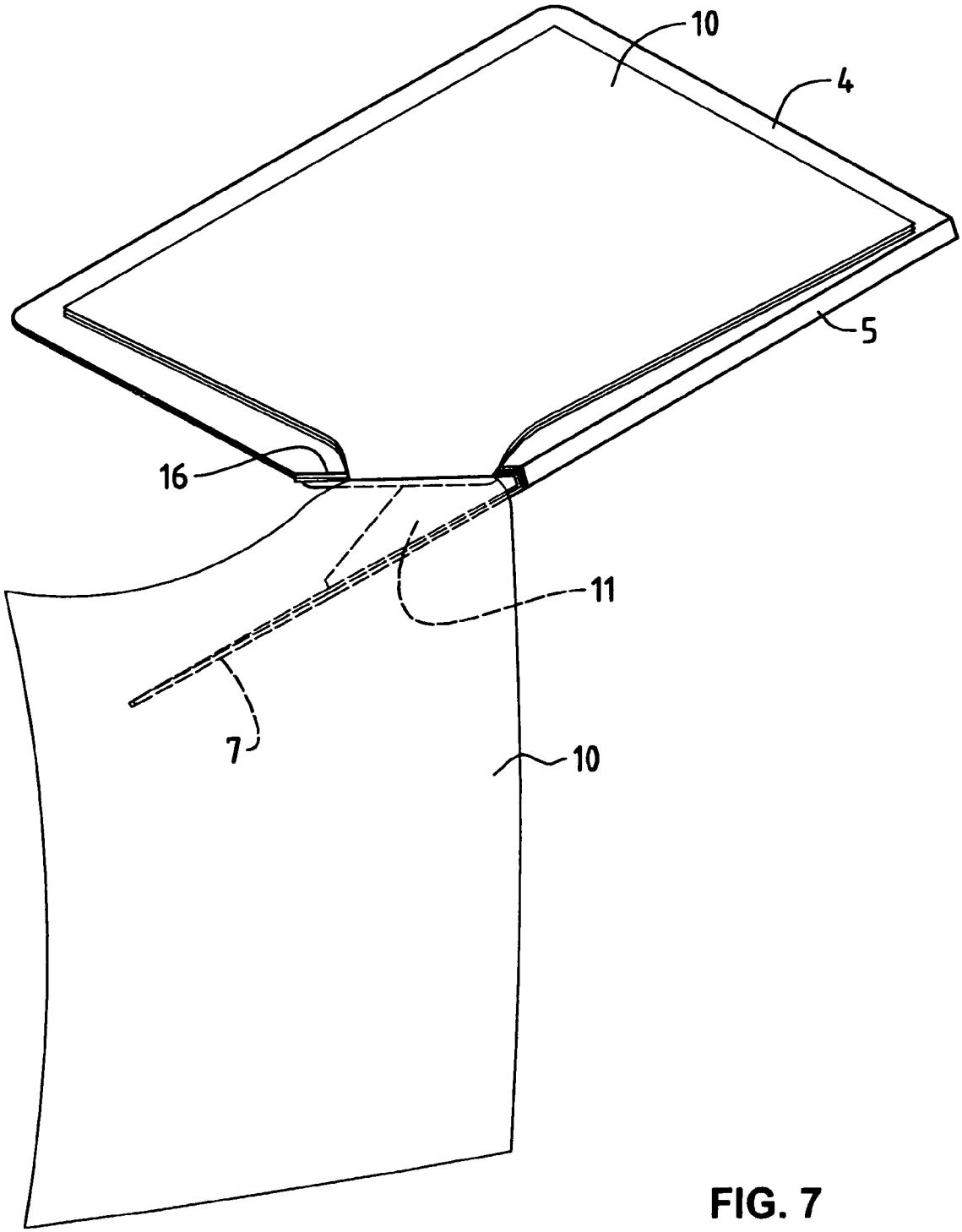
FIG. 7 is a spatial representation of the folder according to the invention with front leaf opened practically all the way and corner regions with the clamping device pivoted away, with one page turned.
Figure 8:
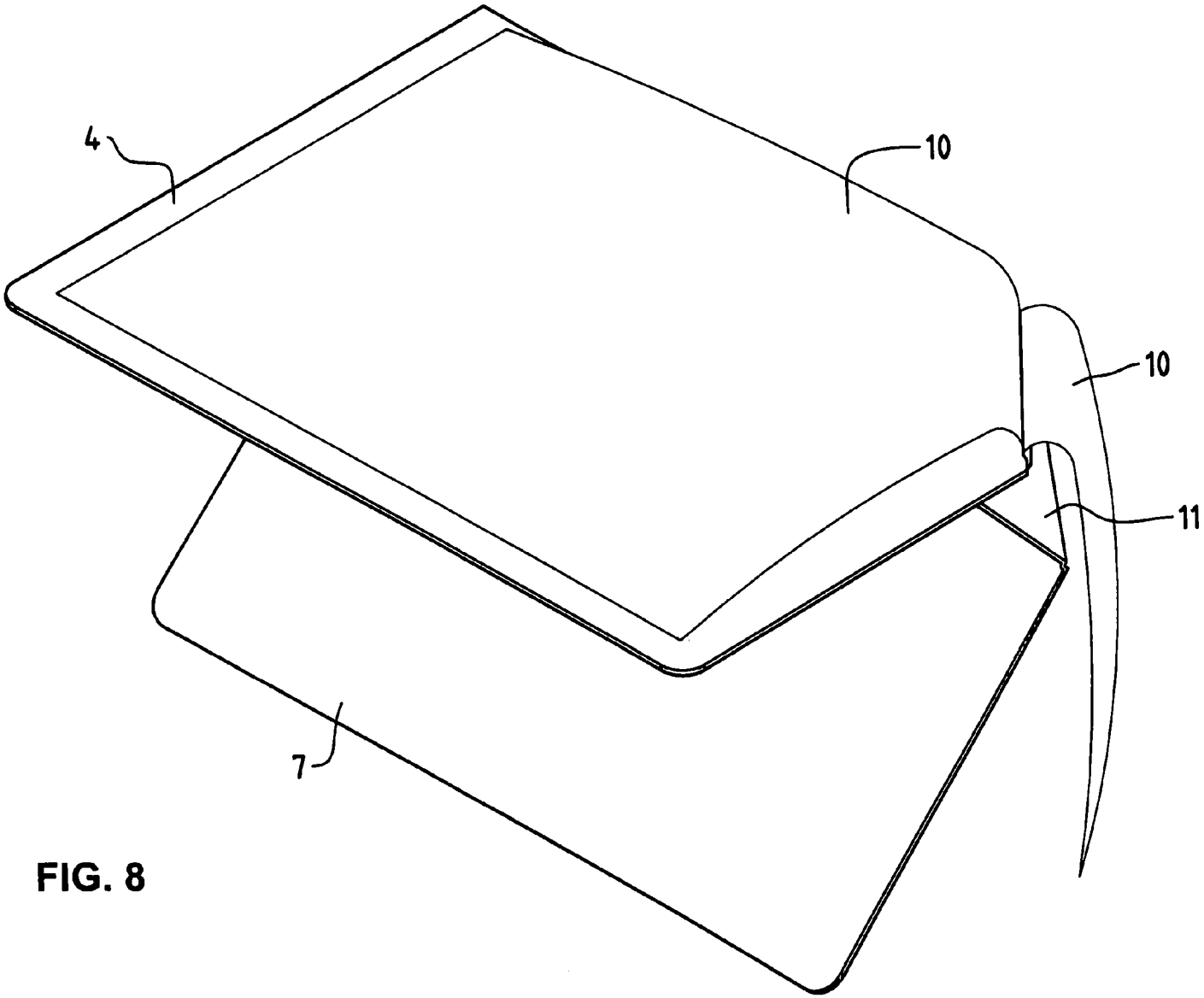
FIG. 8 is a spatial representation of the folder according to the invention in the state as shown in FIG. 7, seen from another perspective.

Seen from FIGS. 7 and 8 is that, with complete bending back of the front leaf 7 until it practically comes to lie on the back side of the rear leaf 4, the corner region 8 of the rear leaf and the corner region 11 of the front leaf 7, together with the clamping device 9, are flipped back between the rear leaf 4 and the front leaf 7. Space is thereby created in the corresponding corner area of the material in sheet form 10, so that this material in sheet form can also be turned over without impediment. The turning edge is hereby formed by the first crease 16 of the rear leaf 4.

Figure 6:
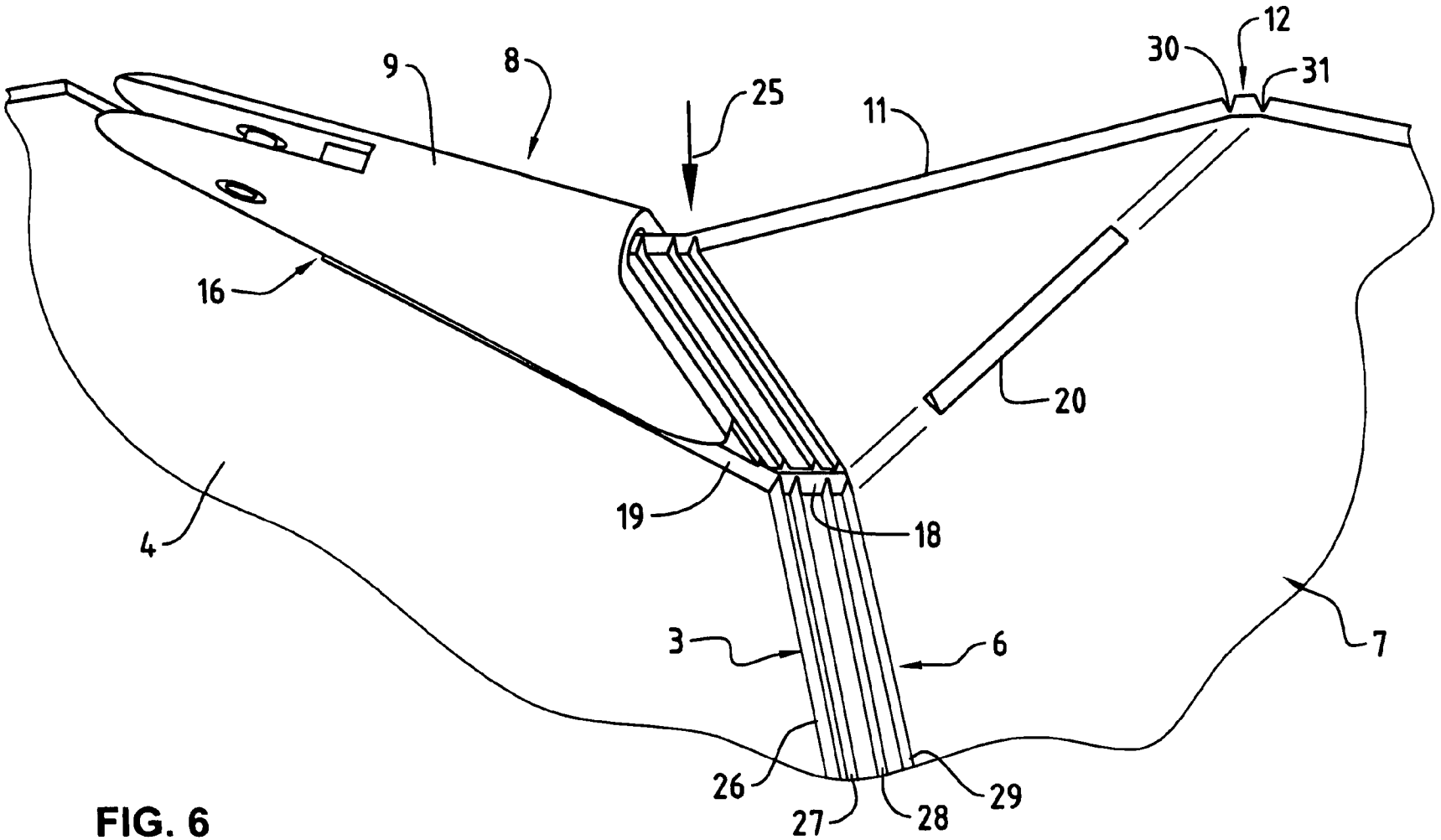
FIG. 6 is an enlarged spatial representation of the two corner regions with the clamping device in the state as shown in FIG. 5.

FIG. 6 shows in an enlarged spatial representation the corner region 11 of the front leaf 7 and the corner region 8 of the rear leaf 4, on which the clamping device 9 is disposed. It can be seen from this figure that the first indentation configuration 3 is formed by two folding lines 26 and 27 running parallel to one another, while the second indentation configuration 6 is formed by two folding lines 28 and 29 running parallel to one another. These folding lines 26 to 29 are stamped impressions made in the material forming the jacket 2. The material forming the jacket 2 here preferably consists of a soft, flexible plastic. The first crease 16 and the second crease 12 are also each formed by two folding lines 30 and 31 running parallel to one another, as can be seen only for the second crease 12. The stamped impressions here can each be made in the jacket 2 from one side; they can also be made in the jacket 2 from different sides, however, depending upon on which side the respective part to be folded of the jacket is to be folded. Also conceivable is that the stamped impressions are made in the jacket on both sides at the same time.

In the position shown in FIG. 6, the front leaf 7 is opened with respect to the rear leaf 4 already by more than 180 degrees, whereby the corner region 8 of the rear leaf 4, with the clamping device 9 disposed thereon, and the corner region 11 of the front leaf 7 are flipped back about the first crease 16 and the second crease 12. Through the arrangement of the folding lines 30 and 31 of the first crease 16 and of the second crease 12 and the arrangement of the folding lines 26 to 29 of the first indentation configuration 3 and of the second indentation configuration 6, which continue into the corner regions 8 and 11, as well as the arrangement of the cut 18, of the further cut 19 and of the additional cut 20, it is ensured that the two corner regions 8 and 11, and thus the clamping device 9, bend out in the so-called correct direction, shown by arrow 25. The cuts 18, 19 and 20 have the effect that no crushing of the material of the jacket occurs in these bent-out areas that could impede the sequence of movement which is desired. Of course it would also be conceivable, in particular with thin jacket material, to omit the cuts at least in part, without the functionality being thereby impaired.

Created through the present invention is a folder which makes it possible to turn back the front leaf all the way until it lies on the rear leaf, the corner region with the clamping device being folded such that the material in sheet form held clamped in this folder is able to be turned around this cleared corner in an optimal way. This is especially advantageous when the folder is held in one hand while the sheets are able to be turned using the other hand.

The invention claimed is:

1. A folder with a clamping device for receiving material in sheet form, comprising a jacket made of a flat, flexible material, which is divided up by means of a first indentation configuration into a rear leaf and a backbone part, and by means of a second indentation configuration into the backbone part and a front leaf, and the clamping device is provided in a corner region of the rear leaf adjacent to the backbone part, so that the material in sheet form insertable in the folder is able to be held clamped in the respective corner region by means of the clamping device, wherein the corner region of the rear leaf, in which the clamping device is provided, is delimited with respect to the rear leaf by at least a first crease, which first crease runs from the first indentation configuration to the top edge of the rear leaf, and wherein the corner region of the front leaf, corresponding to the corner region of the rear leaf, is delimited with respect to the front leaf by at least one second crease, which second crease runs from the second indentation configuration to the top edge of the front leaf.

2. The folder according to claim 1, wherein the first crease and the second crease are disposed symmetrically with respect to the backbone part, and each run from the backbone part at an angle of inclination of about 45°.

3. The folder according to claim 1, wherein between the first crease and the second crease a cut is provided in the backbone part.

4. The folder according to claim 1, wherein the first crease and the second crease are each formed by at least two folding lines running parallel to one another.

5. The folder according to claim 1, wherein the first indentation configuration and the second indentation configuration are each formed by at least two folding lines running parallel to one another.

6. The folder according to claim 4 or 5, wherein the folding lines are provided as impressions stamped in the material forming the jacket.

7. The folder according to claim 3, wherein adjacent to the cut provided in the backbone part is a further cut which runs along the first crease in the rear leaf and which extends to a middle region of the overall length of the first crease.

8. The folder according to claim 3 or 7, wherein an additional cut is provided in the front leaf along a middle region of the overall length of the second crease.

9. The folder according to claim 7, wherein disposed on the rear leaf in the corner region at the edge is a tab, which is able to be turned down about a further crease, aligned parallel to the edge, in the corner region of the rear leaf.

10. The folder according to claim 1, wherein the clamping device is formed by two clamping surfaces lying one above the other, which are connected to each other via a crosspiece, and take the shape of a triangle corresponding substantially to the corner region formed by the first crease.

11. The folder according to claim 10, wherein the clamping device is provided with a bolt aligned perpendicular to the clamping surfaces which bolt penetrates the rear leaf in the corner region, and about which bolt the clamping device is pivotable.

12. The folder according to claim 1, wherein the clamping device is made of a flexible material.

* * * * *